US006470811B1

(12) United States Patent
Isinger

(10) Patent No.: US 6,470,811 B1
(45) Date of Patent: Oct. 29, 2002

(54) PIECE OF FURNITURE

(76) Inventor: Bernd Isinger, Hauptstrasse 2, D-65207 Wiesbaden-Igstadt (DE)

( * ) Notice: Subject to any disclaimer, the term of this patent is extended or adjusted under 35 U.S.C. 154(b) by 8 days.

(21) Appl. No.: 09/675,611

(22) Filed: Sep. 29, 2000

(30) Foreign Application Priority Data

Oct. 15, 1999 (DE) ..... 99 120 539

(51) Int. Cl.[7] ..... A47B 13/00
(52) U.S. Cl. ..... 108/153.1; 108/158.12
(58) Field of Search ..... 108/153.1, 159, 108/161, 186, 180, 191, 154, 157.14, 157.1, 158.12, 157.18, 157.16, 157.15

(56) References Cited

U.S. PATENT DOCUMENTS

| | | | | |
|---|---|---|---|---|
| 136,056 A | * | 2/1873 | Groves | |
| 210,187 A | * | 11/1878 | Converse | |
| 2,742,116 A | * | 4/1956 | Fitzgerald | |
| 3,620,175 A | * | 11/1971 | Crane et al. | |
| 3,724,399 A | * | 4/1973 | Notko et al. | 108/157.14 |
| 4,078,502 A | * | 3/1978 | Barna | 108/157.14 X |
| 4,379,432 A | * | 4/1983 | Grossman | 108/159 X |
| 4,519,318 A | * | 5/1985 | Weldon-Ming | 108/159 X |
| 4,760,802 A | * | 8/1988 | Leong | 108/157.1 |
| 5,018,454 A | * | 5/1991 | Negus | 108/157.14 X |
| 5,125,348 A | * | 6/1992 | Horwitz | 108/153.1 X |
| 5,402,738 A | * | 4/1995 | Carr et al. | 108/157.14 |
| 5,967,060 A | * | 10/1999 | Savoie | 108/157.1 |
| 6,205,936 B1 | * | 3/2001 | Nelson et al. | 108/157.1 |

FOREIGN PATENT DOCUMENTS

DE 299 04 536 U 1 3/1999 ..... A47B/47/00

OTHER PUBLICATIONS

European Search Report, Mar. 22, 2000, 3 pgs.
Brevet D'Invention, No. 1,069,648, Henri Clement, 2 pgs.

* cited by examiner

*Primary Examiner*—Jose V. Chen

(57) ABSTRACT

The piece of furniture is constructed from the following elements: base panel (1), top panel (2) and flexible wall (3), it being possible for the flexible wall to be fitted into grooves (10) of the base and top panels and fastened by touch-and-close strips (20). It is possible to construct counters and other pieces of furniture in many different forms. Assembly can be carried out quickly without the use of tools, and the same applies to the dismantling operation. The elements can be stacked as flat components.

19 Claims, 6 Drawing Sheets

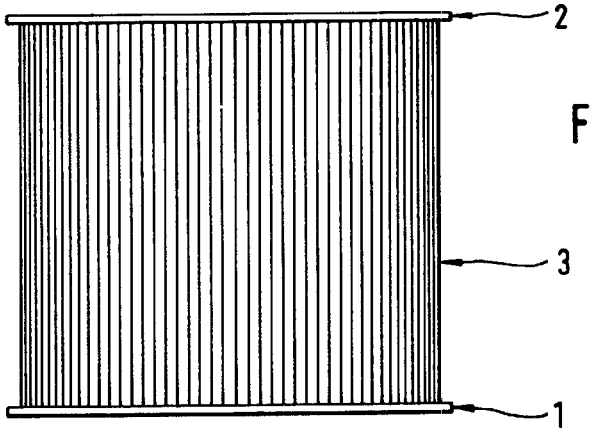
Fig. 1
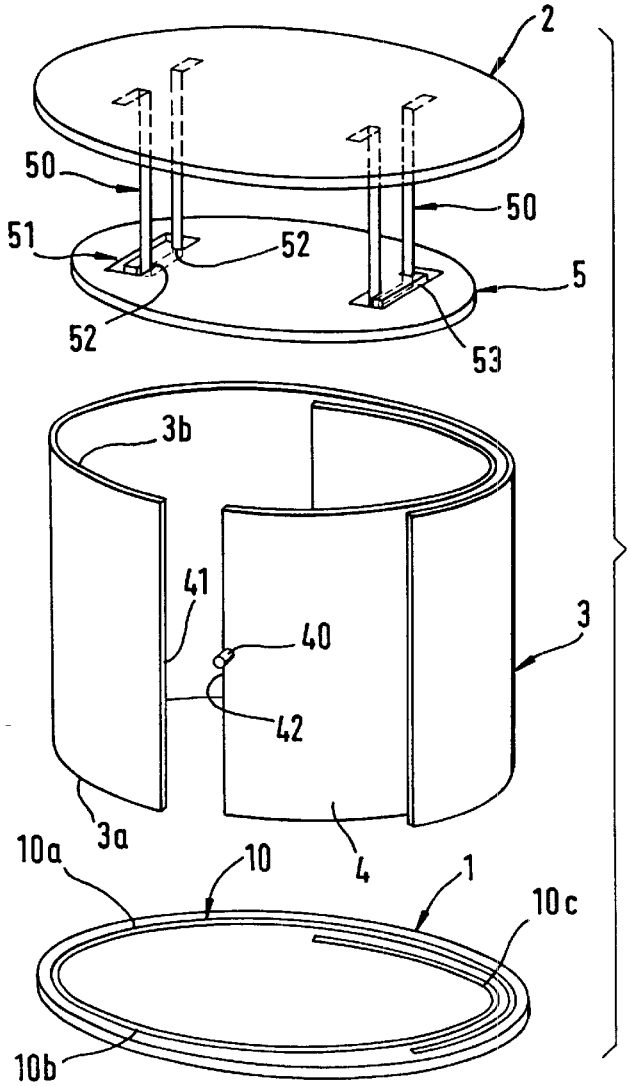
Fig. 2
Fig. 3
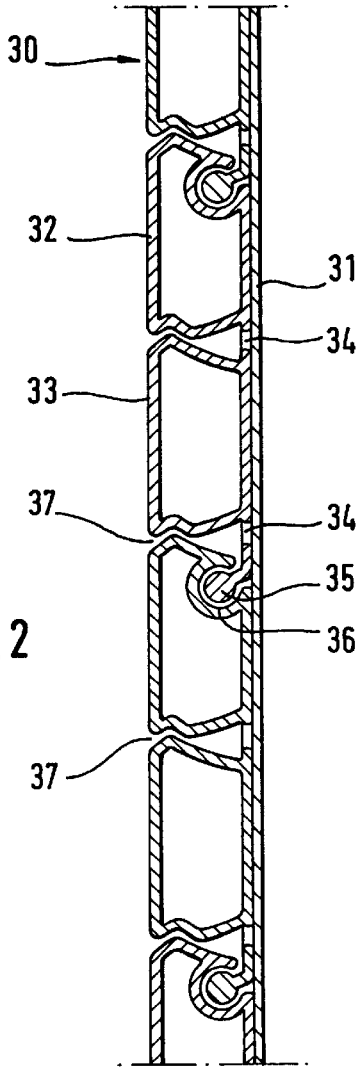

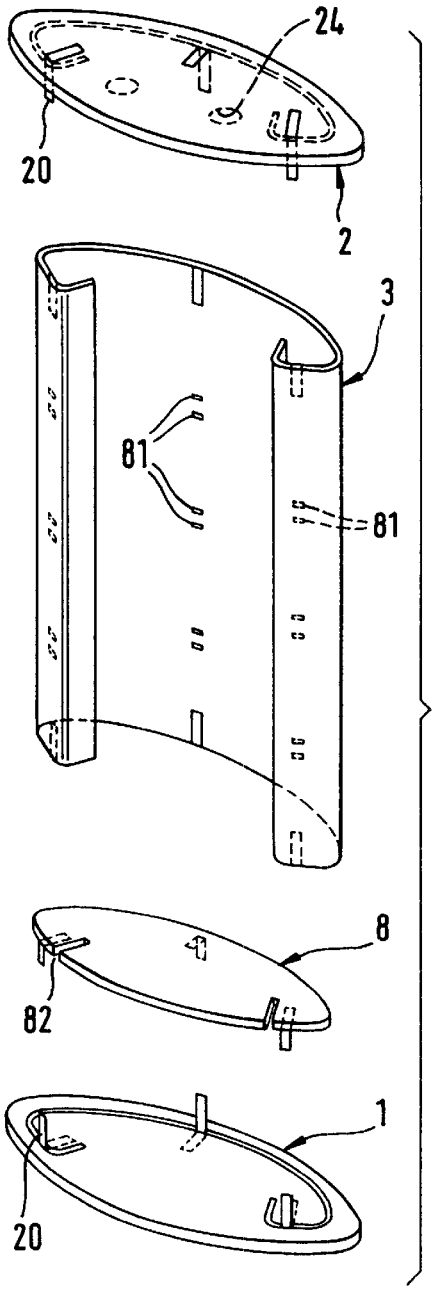
Fig. 10
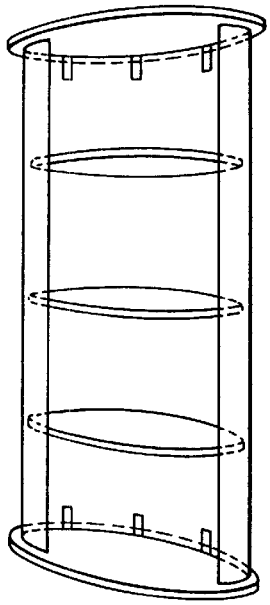
Fig. 13
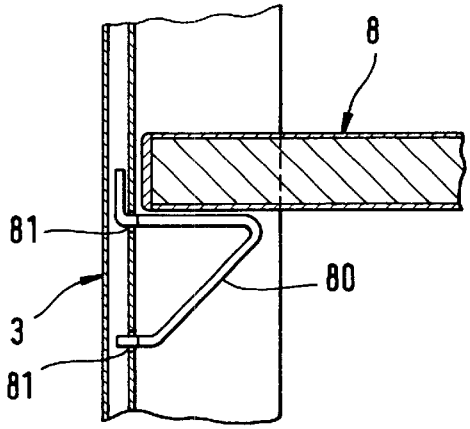
Fig. 12
Fig. 11
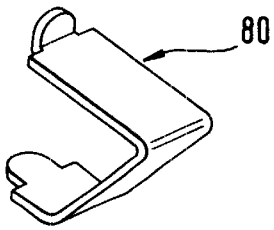

PIECE OF FURNITURE

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

The invention relates to a piece of furniture which is assembled from furniture elements and can be dismantled again in order to take up just a small storage volume.

In the mail-order business and in specific furniture outlets, the customer is supplied with pieces of furniture which have been dismantled into their individual parts, the customer then following assembly instructions in order to assemble and set up the same. This is usually a one-off operation.

For exhibitions, fairs and the like, it is necessary to have counters and similar pieces of furniture which can easily be stored in a space-saving manner during periods between the exhibitions. Such pieces of furniture should therefore be constructed such that they can be assembled and dismantled quickly and easily, and that this operation can be repeated frequently without any damage to the piece of furniture being expected.

The object of the invention is thus to specify a piece of furniture which can be assembled and dismantled easily and repeatedly and, in the dismantled state, can be packed together to take up just a small storage volume.

SUMMARY OF THE INVENTION

The set object is achieved by the features of claim 1 and is configured and developed further by the rest of the features of the dependent claims.

The novel piece of furniture has the particular advantage that it has a distinctive appearance. This is achieved by the contrast between horizontally extending structural elements and vertically extending structural elements, the latter being emphasized by a channel structure in the vertical direction.

A further advantage of the novel piece of furniture is that it can be constructed and dismantled without the use of tools.

BRIEF DESCRIPTION OF THE DRAWINGS

The invention will be described with reference to the drawing, in which:

FIG. 1 shows a basic form of counter, as seen from the side,

FIG. 2 shows a perspective view of an exploded illustration of the individual parts of the counter, FIG. 3 shows an enlarged detail, namely a cross FIG. 10 shows a rack in an exploded illustration, FIG. 11 shows a hook, FIG. 12 shows a cross section through insert base and wall, FIG. 13 shows a constructed rack.

DETAILED DESCRIPTION OF THE INVENTION

Figure 8:
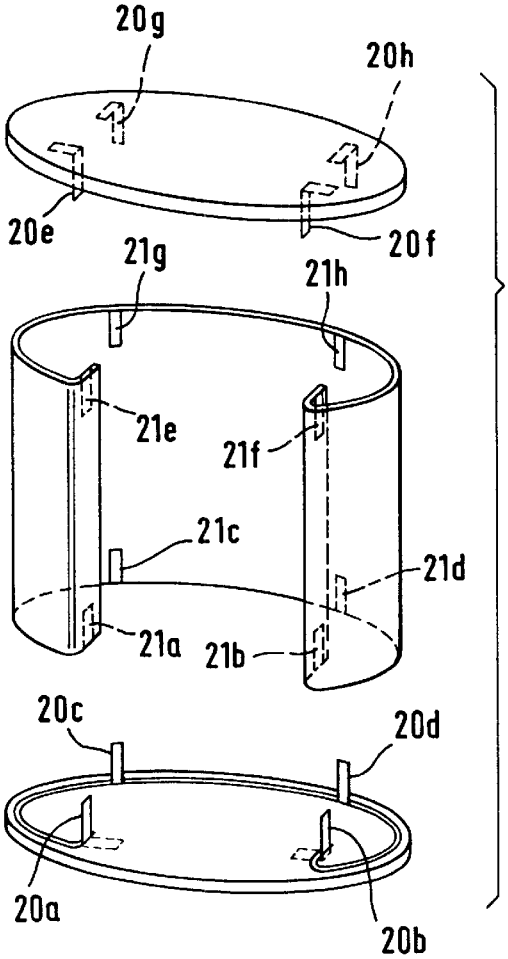
FIG. 8 shows a further basic form of counter in an exploded illustration.
Figure 9:
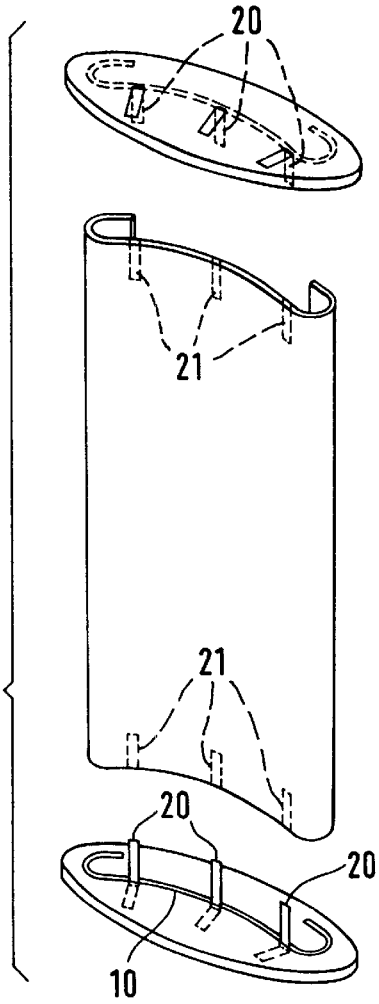
FIG. 9 shows a display wall in an exploded illustration.

FIG. 1 shows a possible basic form of counter, as seen from the side. As can be seen from FIG. 2, the fundamental elements of the counter are a base panel 1, a top panel 2 and a curved wall 3. A flexible sliding door 4 and an insert base 5 may be added thereto. The base panel and the top panel are oval in basic shape. A groove 10 is provided in loop form on the top side of the base panel 1, a region 10*a* being designed as fastening groove and regions 10*b*, 10*c* being designed as running or guide grooves. On the underside, the top panel 2 likewise bears a groove 10 (not illustrated). The wall 3 is flexible and introduced into the grooves 10 and is retained by touch-and-close strips 20 which are distributed on the circumference of the groove 10, as is illustrated in FIGS. 8 and 9. It is also possible to utilize other embodiments of quick-action connectors, for example tying-type connectors.

FIG. 3 shows an enlarged cross section of part of the flexible wall 3 and/or of the sliding door 4. The flexible wall is constructed from individual hollow profiled lamellae 30 and an elastically extensible adhesive sheet material 31 or individual pieces of adhesive sheet material which span the lamellae 30, and are connected to one another, on the inside of the wall. This means that the lamellae 30 are prevented from slipping in relation to one another, but their flexibility in the direction transverse to the longitudinal extent of the lamellae is not impaired in any way. It is possible to use commercially available plastic lamellae which each comprise two box profiles 32, 33, flexible connecting webs 34 and a pivot-bearing extension 35 which engages in a bearing groove 36. Formed between the hollow profiles 32, 33 are channels 37 which give the wall a distinctive appearance.

Depending on the curvature of the wall, the channels 37 are open to a more or less wide extent.

Figure 4:
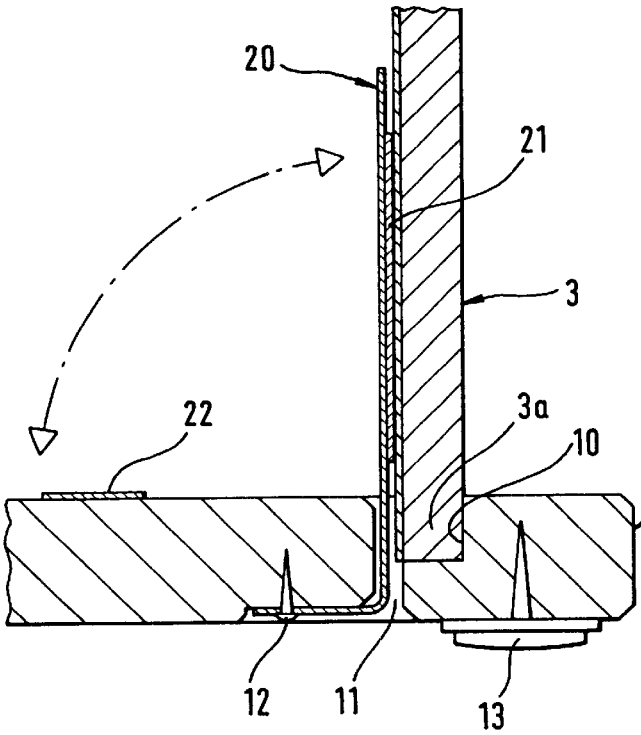
FIG. 4 shows a design detail in section.

FIG. 4 shows a touch-and-close strip 20 as fastened on a base panel 1. It is also possible to use other types of quick-action closure strips. The sectional illustration of FIG. 4 shows how the bottom border 3*a* of the flexible wall 3 engages in the groove 10 and fills the same. A slot 11 is milled adjacent to the groove 10, the slot leading through the base panel and the length thereof corresponding to the width of the strip 20. The touch-and-close strip 20 is fastened on the underside of the base panel, for example by nails 12. Provided on the inside of the flexible wall 3, in the region of the strip 20, is a mating fastening surface 21 which interacts with the touch-and-close strip 20 and can form a touch-and-close interconnection. Mating fastening patches 22 are also provided on the top side of the base panel 1 in order to secure the respectively associated touch-and-close strips 20 when the piece of furniture is being stored. Feet 13 are provided on the underside of the base panel 1.

Figure 5:
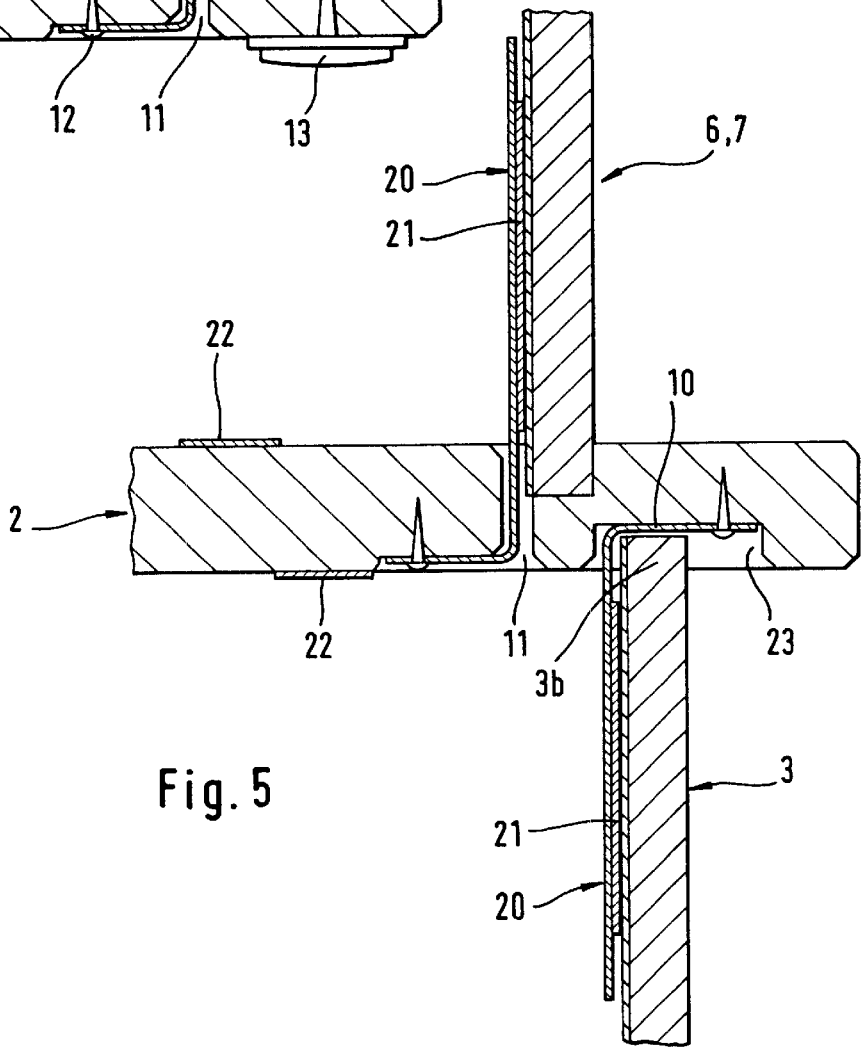
FIG. 5 shows a further design detail in section.

FIG. 5 shows the connection of the top panel 2 to the top border 3*b* of the flexible wall 3. Use is made, once again, of touch-and-close strips 20 and fastening surfaces 21. However, a lateral milled relief 23 is utilized instead of a through-slot 11.

With reference to FIG. 2, the insert base 5 is retained at a certain distance beneath the top panel 2 by means of strap loops 50. The respective ends of the strap loops 50 are fastened on the underside of the top panel 2, for example clamped in a bore with wooden pegs and adhesively bonded. The insert base 5 has two U-shaped slots 51, of which the slot ends 52 are turned toward the interior of the U. The strap loop can be drawn through said slots and hooked in securely at the inwardly directed slot ends 52. The dismantling operation is extremely straightforward the insert-base 5 is raised a little to give a length of strap loop beneath the insert base, and said strap loop is pushed into the connecting leg 53 of the U, with the result that the insert base can then be drawn downward.

The sliding door 4 consists of the same material as the wall 3, but is somewhat lower in height than the wall 3. The door 4 can be gripped by a handle 40 and displaced out of the groove region 10*b* into the groove region 10*c*. The door 4 can be rendered lockable by a lock 41, 42 being provided in the region of the vertical borders of the wall and door.

Figure 6:
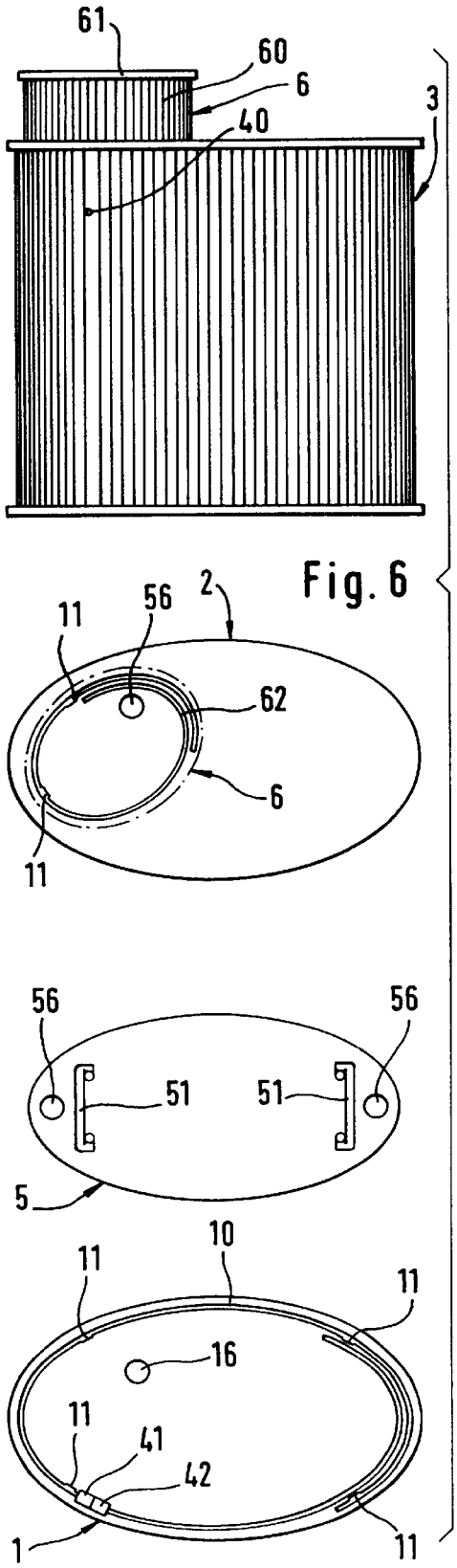
FIG. 6 shows a counter with an oval top attachment.

FIG. 6 shows the rear side of a counter with door and a top attachment 6 with flexible wall 60 and top panel 61 as well as outlines of the base panel 1, the top panel 2 and inset base 5. As can be seen, the top attachment 6 of the counter repeats the basic form of the counter according to FIG. 1, but is turned round slightly. The groove 62 on the top side of the top panel 2 forms an overlapping loop for receiving a sliding door. The base panel 1, top panel 2 and insert base 5 each have a bore 16, 26 and 56, respectively, for the through-passage of cables and the like.

Figure 7:
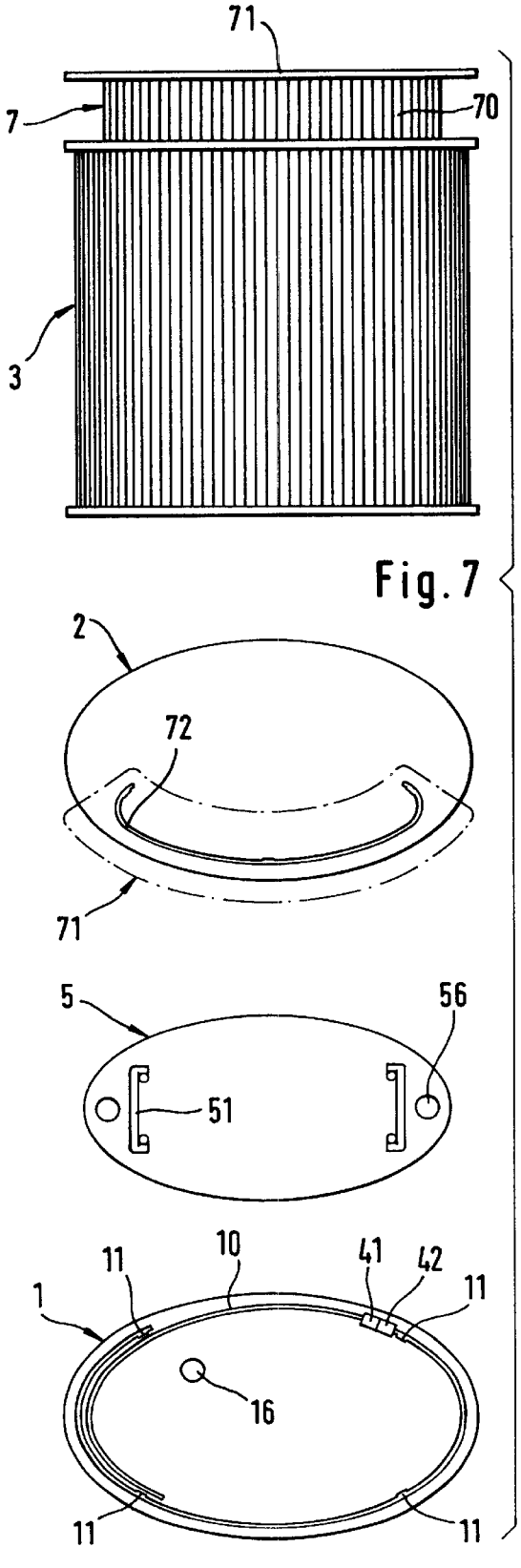
FIG. 7 shows a counter with an arcuate top attachment.

FIG. 7 shows a further exemplary embodiment of a counter with top attachment 7 and associated outlines. The top attachment of the counter has a flexible wall 70, which is arcuate in shape, and a top-attachment panel 71. The top side of the top panel 2 and the underside of the top-attachment panel 71 each have an arcuate groove 72, and these grooves receive the top and bottom borders of the arcuate wall 70.

FIG. 5 shows that the wall of the top attachment 6 or 7 is fastened similarly to the flexible wall 3, so there is no need to repeat the description of this here.

FIG. 8 shows that it is possible to produce a lamellar counter in the basic form of the top attachment 7. The touch-and-close strips 20*a* to 20*h* and the associated fastening locations 21*a* to 21*h* are illustrated in FIG. 8.

FIG. 9 shows a display wall, which may also serve as the rear side of a rack.

FIGS. 10 to 12 show the individual parts of such a rack which has additional insert bases 8 which are fastened by hooks 80 in slots 81 of the curved wall 3. The insert bases 8 may have slots 82 in order to be guided on the border of the wall 3. The top panel 2 also has cutouts 24 for receiving a lighting means (not illustrated). An exemplary embodiment of a rack is shown in FIG. 13.

Figure 14:
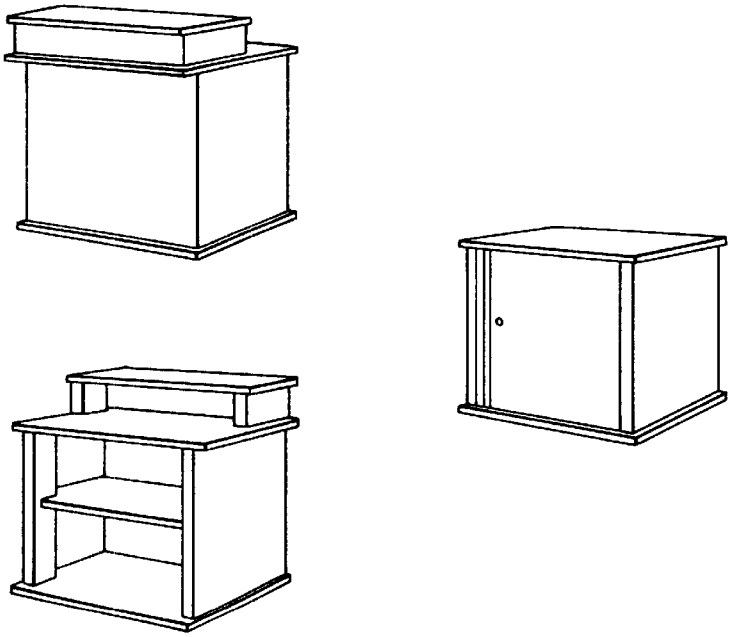
FIG. 14 shows bar-like counters.

It is also possible for the counters or racks, instead of being round in shape, to be of angular construction. FIG. 14 shows such counters with and without a top attachment.

Figure 15:
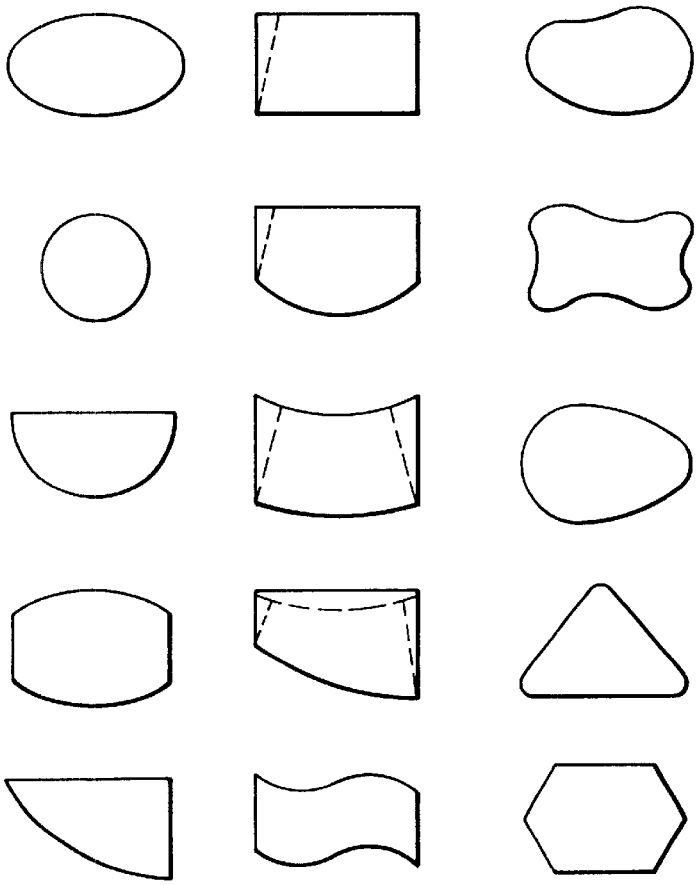
FIG. 15 shows possible outlines of counters or rack-like pieces of furniture.

FIG. 15 shows further possible outlines of the furniture according to the invention. Accordingly, the basic form can be widely modified, and this also applies to the top attachments. It is possible to realize many different forms.

Common to all the embodiments is the possibility of dismantling into flat individual parts which can be stacked one upon the other. This also applies to the walls 3 and doors 4 since these can be bent back into one plane. The fastening surfaces 21 are utilized for coupling the parts 3, 4 to the parts 1, 2 once the touch-and-close strips 20 have been pivoted onto the patches 22, in order thus to form mating fastening surfaces. The touch-and-close strips and touch-and-close patches thus form a firm means of interconnection in the stacked position.

In the upright position (FIGS. 8, 9), the touch-and-close strips 20 allow the pieces of furniture to be assembled without the use of tools. For this purpose, the walls 3, 4 are introduced into the grooves 10 and fastened by the touch-and-close strips 20.

In the case of the racks, the hooks 80 are fitted into the slots 81 and then the bases 8 are positioned on the load-bearing side of the hooks. The lighting means are fitted into the cutouts 24 provided for this purpose, and the piece of furniture is set up for its intended purpose.

What is claimed is:

1. A piece of furniture comprising:

a base panel having a top side, an underside and a groove in the top side;

a top panel having a top side, an underside and a groove in the underside;

a flexible wall comprising a plurality of parallel lamellae and sheet material for connecting said plurality of lamella to form said wall, said lamellae each having generally vertical sides with profiled portions for interengaging complementary profiled portions of an adjacent lamella, and generally horizontal upper and lower sides, said upper horizontal sides of said plurality of lamella forming an upper border of said flexible wall and said lower horizontal sides of said plurality of lamellae forming a lower border of said wall, said lower border fitting into said groove of said base panel and said upper border fitting into said groove of said top panel, and connecting and disconnecting means for connecting, and disconnecting, said flexible wall to and from said base panel, and connecting and disconnecting said top panel to and from said flexible wall so as to hold said base panel, said flexible wall and said top panel together when the piece of furniture is assembled, said connecting means being such as to allow disconnecting said base panel, top panel and flexible wall from one another and taking up just a small storage volume.

2. The piece of furniture as claimed in claim 1, wherein said connecting means comprise loop and hook fastener means, one of said loop and hook fastener means forming fastening surfaces on said flexible wall near said upper and lower borders thereof, and the other of said loop and hook fastener means forming flexible stripes, each with a first and a second end, said first ends of some of said stripes being fastened at said base panel and said first ends of others of said stripes being fastened at said top panel whereas said second ends of said stripes co-operate with said fastening surfaces when the piece of furniture is assembled.

3. The piece of furniture as claimed in claim 2, wherein said flexible stripes of said loop and hook fastener means are fastened in slots which are provided at intervals along said grooves of said base and top panels.

4. The piece of furniture as claimed in claim 2, wherein further fastening surfaces are provided on said top panel and said base panel arranged to co-operate with said flexible stripes in order to be utilized as securing means during transportation of a disassembled piece of furniture.

5. The piece of furniture as claimed in claim 1, further comprising an insert base having a pair of U-shaped slots, and a pair of strap loops which are fixed to the underside of said top panel, said pair of strap loops co-operating with said slots of said insert base so as to hold the insert base suspended, when the piece of furniture is assembled.

6. The piece of furniture as claimed in claim 1, wherein said groove in the top side of said base panel and said groove in the underside of said top panel form an open clasp-shaped loop, the piece of furniture being designed as a counter.

7. The piece of furniture as claimed in claim 6, further comprising a flexible wall element, and wherein each of said clasp-shaped grooves continues in a respective guide groove having an overlap region overlapping said open loop, said flexible wall element being guided in said guide grooves so as to form a sliding door which is adapted to be pushed into the overlap region of the guide grooves so as to release an opening into the piece of furniture.

8. The piece of furniture as claimed in claim 6, further comprising a top attachment including a second top panel and a second lamellar wall, and wherein said top side of said top panel and an underside of said second top panel are formed with further groove means so as to co-operate with said second lamellar wall.

9. The piece of furniture as claimed in claim 8, wherein said further groove means in the top side of said top panel and in the underside of said second top panel are arcuate.

10. The piece of furniture as claimed in claim 8, wherein said further groove means in the top side of said top panel and in the underside of said second top panel form open, clasp-shaped loops.

11. The piece of furniture as claimed in claim 1, which is designed as a display wall.

12. The piece of furniture as claimed in claim 1, which is designed as a rack.

13. The piece of furniture as claimed in claim 1, wherein said base and top panels are oval in shape.

14. The piece of furniture as claimed in claim 1, wherein said base and top panels are circular in shape.

15. The piece of furniture as claimed in claim 1, wherein said base and top panels are semicircular in shape.

16. The piece of furniture as claimed in claim 1, wherein said base and top panels are rectangular in shape.

17. The piece of furniture as claimed in claim 16, wherein said base and top panels each has four side edges, at least one of said side edges being curved, and wherein said flexible wall arranged between said base and top panels is curved in the region of said at least one curved side edge.

18. The piece of furniture as claimed in claim 1, wherein said base ant top panels are triangular in shape.

19. The piece of furniture as claimed in claim 1, wherein said base and top panels are hexagonal in shape.

* * * * *